United States Patent [19]

Yamaguchi et al.

[11] 4,254,182

[45] Mar. 3, 1981

[54] POLYESTER SYNTHETIC FIBER CONTAINING PARTICULATE MATERIAL AND A METHOD FOR PRODUCING AN IRREGULARLY UNEVEN RANDOM SURFACE HAVING RECESSES AND PROJECTIONS ON SAID FIBER BY CHEMICALLY EXTRACTING SAID PARTICULATE MATERIAL

[75] Inventors: Shinji Yamaguchi; Takao Akagi; Takaakira Tsuji; Katsura Maeda; Masao Kawamoto, all of Kurashiki; Akira Kubotsu, Soja, all of Japan

[73] Assignee: Kuraray Co., Ltd., Kurashiki, Japan

[21] Appl. No.: 16,750

[22] Filed: Mar. 2, 1979

[30] Foreign Application Priority Data

Mar. 8, 1978 [JP] Japan ..... 53/27088

[51] Int. Cl.[3] ..... B44C 1/22; D02G 3/00; D06M 5/02

[52] U.S. Cl. ..... 428/372; 156/657; 264/49; 264/344; 428/400

[58] Field of Search ..... 264/49, 344; 156/657; 428/372, 400

[56] References Cited

U.S. PATENT DOCUMENTS 4,055,702 10/1977 Guthrie et al. ..... 428/372

FOREIGN PATENT DOCUMENTS 43-14186 6/1968 Japan .
43-16665 7/1968 Japan .

*Primary Examiner*—James C. Cannon
*Attorney, Agent, or Firm*—Barry Kramer

[57] ABSTRACT

A polyester fiber having an irregularly uneven random surface, having nonuniform recesses and projections forming said surface satisfying the requirement 0.2 micron $<X<$ 0.7 micron where X is the planar distance from the deepest point of a recess to the deepest point of another recess located adjacently thereof in the circumferential direction perpendicular to the fiber axis and being present at the density of 10 to 50 in each planar distance of 10 microns in the circumferential direction perpendicular to the fiber axis. Said recesses and projections constituting the random surface have additional microfine recesses and projections within the size range of 50 to 200 millimicrons. A method for producing a polyester synthetic fiber having the above surface structure is also described. The fiber thus obtained features excellent dyeability, i.e. the development and depth of color, and an excellent surface hand.

10 Claims, 7 Drawing Figures

Figure 1:
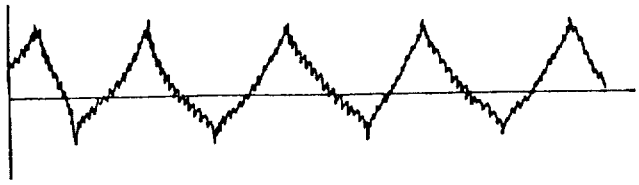

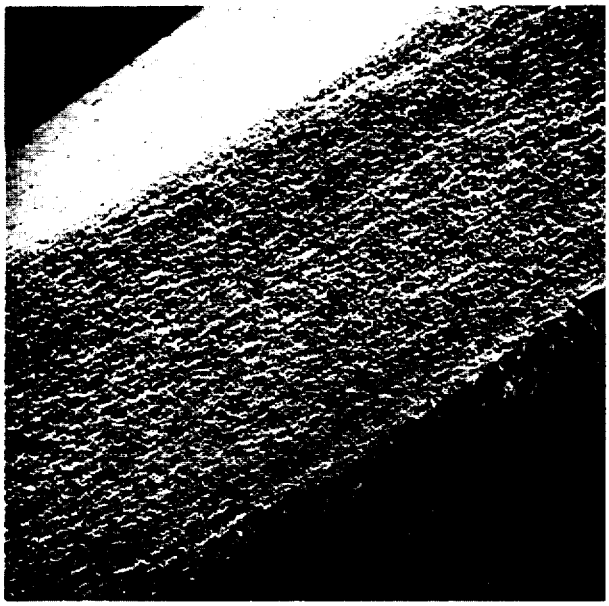
FIG. 4 x 3000
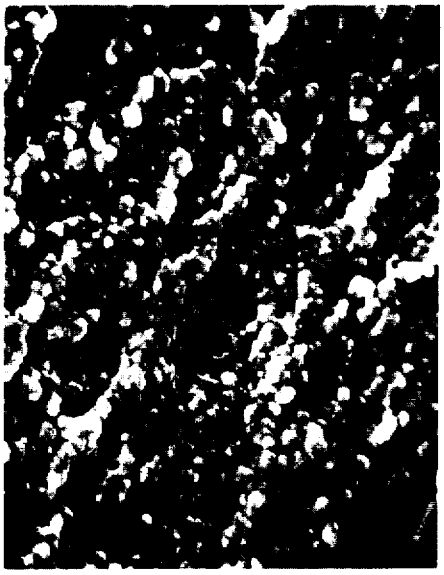
FIG. 5 x 24000
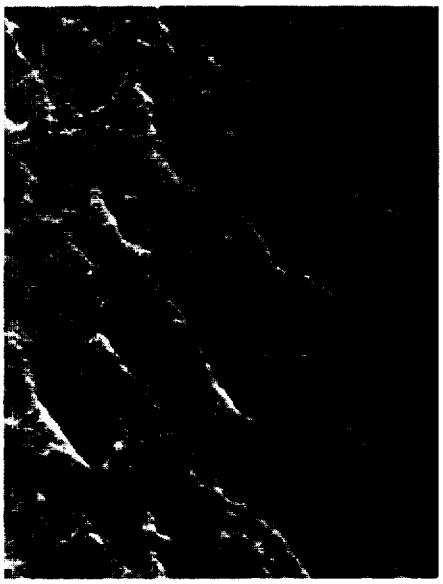
FIG. 6 x 24000

POLYESTER SYNTHETIC FIBER CONTAINING PARTICULATE MATERIAL AND A METHOD FOR PRODUCING AN IRREGULARLY UNEVEN RANDOM SURFACE HAVING RECESSES AND PROJECTIONS ON SAID FIBER BY CHEMICALLY EXTRACTING SAID PARTICULATE MATERIAL

This invention relates, in one aspect, to a polyester synthetic fiber having an irregularly uneven random surface formed by the recesses and projections in which microfine recesses and projections are present and, in another aspect, to a method for producing said polyester fiber.

The conventional organic synthetic fibers and particularly the synthetic fibers manufactured by melt-spinning processes have a characteristic waxy hand because of the excessive smoothness of the surfaces and are inferior to natural fibers in respect of friction-associated feelings such as dry touch, "kishimi" (confriction) and the so-called "silk voice", and surface properties such as the cool and dry feeling which is characteristic of cotton. Furthermore, melt-spun synthetic fibers have a characteristic specular gloss and, when dyed for instance, do not provide adequate depths of color which are found in natural fiber materials such as wool and silk.

A variety of alternative processes have heretofore been proposed to overcome the above-mentioned disadvantages. It has been described in the specification of Japanese Patent Publication No. 39055/1970, for instance, that it is useful to manufacture a fiber by incorporating 0.05 to 30 weight percent of silica in the size range of 10 to 150 microns in the polymer so as to produce surface projections. Japanese Patent Publication No. 26887/1971 describes a process which comprises contacting a crystallizing agent with an amorphous undrawn fiber, removing the crystallizing agent to leave a formed material consisting of an amorphous core and a crystalline skin and finally drawing the same to produce a rugged surface.

It is true that the fibers manufactured by such processes represent some improvements in friction characteristics but their overall qualities are by no means comparable to those of natural fibers. Thus, the recesses and projections of such fibers are large and the densities of such recesses and projections of the fibers were too low. In other words, the fibers are very deficient in gloss and clarity, failing to give, on dyeing, a sufficient brightness and depth of color but giving only pastel shades.

In addition to the above processes, several attempts have been made to improve the surface morphology and physical properties of fiber by way of removing a heterogenous additive from a preformed fiber. A process typical of this group of technology comprises spinning a conjugate fiber from a polymer blend or by a conjugate spinning procedure and then extracting a component from the binary component. This process, however, leaves internal voids after extraction and the resultant opacity or lack of gloss leads only to shallow depths of color. Thus, the conjugate spinning procedure does not provide the desired gloss and depth of color due to the large recesses and projections. In another class of prior art processes, such as those described in Japanese Patent Publications No. 14186/1968 and No. 16665/1968, a particulate inert material is incorporated in fiber and the fiber is then treated with an extractant such as an acid to extract the inert material and, hence, produce the necessary surface irregularities. While this process provides a delustering effect, it leaves voids on drawing and those voids are enlarged as the particulate material is extracted, giving rise to a translucent fiber which, when dyed, is whitish, i.e. of a pastel shade.

It is also known to impart softness to a woven or knitted fabric of polyester fiber by treating it with alkali to hydrolyze its surface layer. However, such process does not lead to any significant improvements, except for increased softness, over untreated fiber or fabrics.

The failure of the prior art processes to provide improvements in gloss, brightness and depth of color and hand or feeling was due to the fact that it has not been known for certain what degree of recesses and projections would be optimal for the characteristics desired in final products. Moreover, from the standpoints of commercial production, technical stability, economics, etc., many of the known processes were commercially unfeasible or at least unsuitable.

This invention is a result of our intensive research into the aspect of surface irregularity of polyester fiber in the perspective of product characteristics and into the possible establishment of a stable commercial production process.

It is, therefore, an object of this invention to provide a polyester synthetic fiber which has been improved in light reflective characteristics as well as in hand.

It is another object of this invention to provide a polyester fiber having a delicate yet intricate irregular surface which is conducive to excellent brightness and depth of color and a delicate hand comparable to that of silk.

It is still another object of this invention to provide a method for the stable commercial-scale production of polyester fiber having a delicate yet randomly intricate surface irregularity.

Other objects and distinctive advantages of this invention will become apparent from the following detailed description.

This invention is thus concerned with a polyester fiber, including various fabrics made thereof, having an irregularly oriented random surface with a multiplicity of irregularly-dimensioned projections or recesses constituting said surface satisfying the definition of 0.2 micron $<X<0.7$ micron where X is the linear distance from the deepest point of a recess to that of the recess adjacent thereto in the circumferential direction perpendicular to the fiber axis, as present at a density of 10 to 50 per every linear distance of 10 microns as measured in the circumferential direction perpendicular to the fiber axis and further having minor recesses or projections within the size range of 50 to 200 millimicrons in said recesses or projections constituting the random surface.

This invention is also concerned with a method for producing the above-described fiber.

Figure 2:
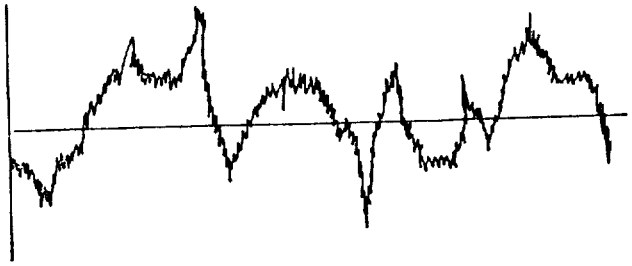

The definition of the recesses or projections in the surface of the fiber in the context of this invention will be further clarified by reference to the accompanying drawings. The common profiles or sectional surface curvatures of fibers are illustrated in FIGS. 1 and 2. A surface is generally classified into one of two configurations, the surface consisting of regular projections or recesses (FIG. 1) and the surface having irregular projections or recesses (FIG. 2). The former is known as a regular surface and the latter as a random surface. The regular surface corresponds to a cut surface that will be produced by cutting with an edge tool, while the random surface is a surface that will be produced by grinding or lapping, for instance. The latter type of surface is what is called the random surface in this specification and the claims appended thereto.

While the random surface according to this invention is typically a surface consisting of recesses of varying depths and projections of varying heights, it may be a surface consisting of recesses of substantially equal depths and projections of substantially equal heights.

Figure 3:
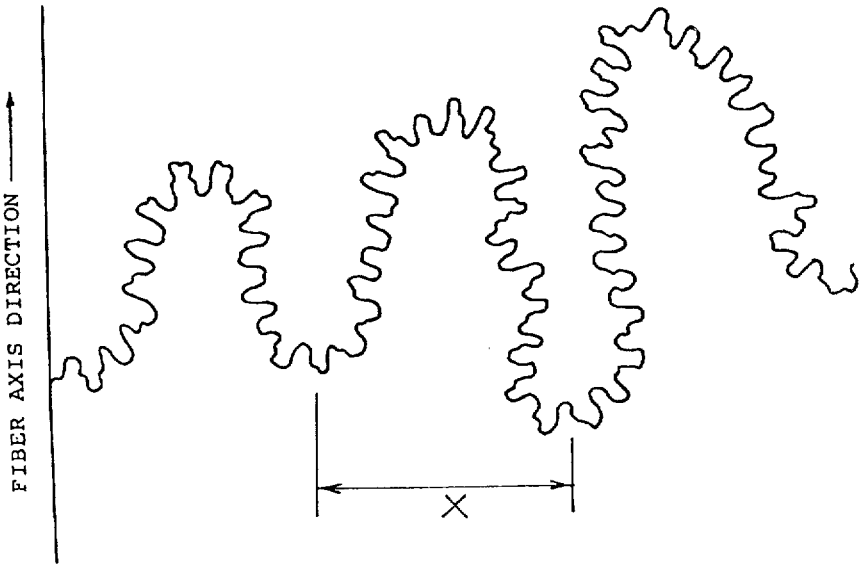

It is important for the purposes of this invention, i.e. in order to avoid the specular gloss and obtain an adequate depth of color, to ensure that the fiber presents an irregular random surface and that each of the projections and recesses constituting the random surface further has a multiplicity of minor projections and recesses within the size range of 50 to 200 millimicrons. FIG. 3 is a schematic sectional representation of such a random surface, showing the presence of delicate minor projections and recesses which are possessed by each major projection or recess.

Preferably, the projections and recesses constituting the random surface satisfy the condition 0.2 micron $<X<0.7$ micron where X is the linear distance from the deepest point of a recess to that of the recess located adjacently thereto in the circumferential direction perpendicular to the fiber axis and the projections and recesses varying in the value of X are present at a density of 10 to 50 per 10 microns of linear distance in the circumferential direction perpendicular to the fiber axis.

While the depth and height of the recesses and projections may be as much as about one-third of the fiber diameter, the geometrical relation of such projections and recesses can be defined by linear distances. On the basis of the above definition of X, the mirror reflection of the light on fiber surface is small when X is below 0.2 micron. Moreover, the depth of color obtainable by the dyeing procedure is only comparable to that obtained by the prior art process and any improvements in friction behavior are not as satisfactory as desired.

When X is greater than 0.7 micron, the reflection of visible light is increased to give the color a whitish cast or clouding effect, thus failing to produce the desired result. Even if X lies within the range of 0.2 to 0.7 micron, neither adequate improvements in the dyeing behavior of polyester fiber nor any satisfactory depth of color can be obtained unless the density of said projections or recesses is at least 10 per 10 microns as measured in the circumferential direction perpendicular to the fiber axis.

Our study of the friction behavior of fiber has shown that a mere increase in the overall coefficient of friction of polyester fiber does not help eliminate its waxy hand, nor does it help produce a silky hand or a cool and dry cottony hand. Thus, in the case of a fibrous product where its coefficient of friction has been increased simply within the knitted or woven structure, only a rough feeling is obtained and, rather, the hysteresis in the recovery process following a bending deformation or a shear deformation of fabrics is increased to rob the fabrics of drapability and pliability. To modify the surface feeling of a fabric and avoid a significant hysteresis in the recovery characteristics of the fabric, it was found to be essential to increase the coefficient of static friction and avoid any marked increase in the coefficient of dynamic friction. Thus, it has been found that the "slip hand" is improved to give a unique feeling when $\mu s/\mu d$ is at least 1.7 and, preferably, at least 1.9 where $\mu s$ is the coefficient of static friction and $\mu d$ is the coefficient of dynamic friction. The coefficients of friction as defined herein are those determined by Röder method which measures the friction between fibers. Thus, in the case of staples, a small amount of tuft fiber comprising doubled staples are stretched in parallel on the peripheral surface of a drum and the frictional force between these fibers on the one hand and the staples placed in contact therewith and perpendicular thereto over one-half of the circumference of the drum is measured. In the case of filaments, untexturized straight filaments are twisted to 150 T/M to 250 T/M and 48 such filaments are arranged on a drum, the diameter of which approximates that of the drum employed for staples, under a tension of 0.1 g/d and the frictional force developed by contact of those filaments with similar filaments over one half of the circumference of the drum is determined. The coefficient of static friction $\mu s$ is calculated from the initial frictional force acting when the drum starts revolving, while the coefficient of dynamic friction is calculated from the frictional force acting when the drum is revolving at a peripheral speed of 90 cm/min.

Even if the fiber has the above desirable frictional behavior, it should nevertheless be a fiber which would develop a sufficient brilliance and depth of color rather than giving a pastel shade. Thus, our research into the correlation of this problem and the surface structure governing $\mu s$ and $\mu d$ has led to the finding that the desired result depends on the finer detail of the surface structure of fiber. Thus, it has been found that the desired behavior is obtained when random surface projections and recesses measuring 0.2 to 0.7 micron are present in the faces of the fiber. If large random surface projections or recesses over 0.7 micron account for a major part of the surface, there is a noticeable rough feeling and poor hand. When the projections or recesses are smaller than 0.2 micron, there is no significant increase in the coefficient of static friction $\mu s$.

Figure 7:
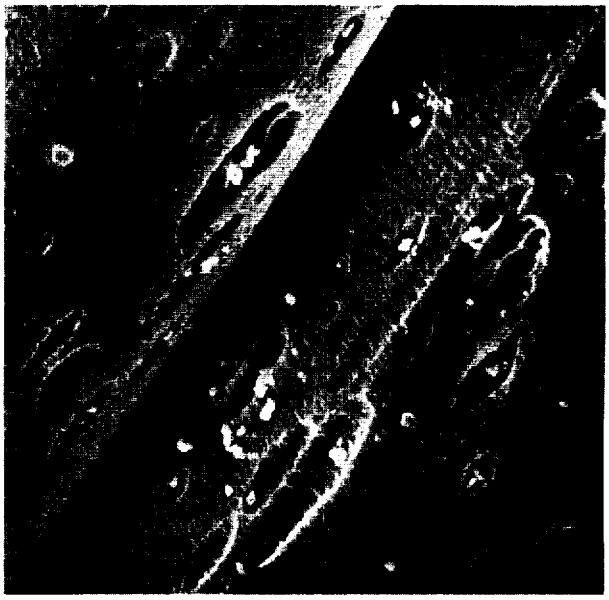

FIGS. 4, 5 and 6 are scanning electron-microphotographs of the polyester fiber embodying this invention, showing the surface structure of the fiber at the magnifications of 3,000 for FIG. 4 and 24,000 for FIGS. 5 and 6. FIG. 7 is a scanning electron-microphotograph showing the surface condition of an ordinary alkali-treated polyester fiber as a control, at the magnification of 6,000. It will be seen from FIG. 7 that mere treatment of ordinary polyester fiber with alkali produces only large holes which are few in number. Therefore, although such treatment helps attain the softening effect described hereinbefore, it does not help obtain dyed products to have sufficient depths of color, nor does it provide a significant increase in the coefficient of static friction.

In contrast, as will be seen from FIGS. 4, 5 and 6, the fiber according to this invention has a surface structure such that it consists of microfine projections and recesses measuring about 50 to 200 millimicrons, typically the fine and multiple projections and recesses formed by delicate grainy walls as shown in FIG. 5, with said fine and multiple projections and recesses constituting an irregular random surface as they are disposed at the density hereinbefore mentioned. Thus, such a surface structure is markedly different from that of conventional alkali-treated fiber shown in FIG. 6. It appears that in the fiber according to this invention, those delicate projections and recesses from 50 to 200 millimicrons act on the light incident on the fiber surface in such a manner that the light rays respectively reflected by those delicate projections and recesses produce a cancellation effect due to phase shifts and that due to the presence of those projections and recesses constituting an irregular random surface, the incident light is retained in the neighborhood of the particular projections or recesses to cause a repeated series of scattering and rescattering so as to attenuate the total reflection. Having the above-described unique surface structure, the fiber according to this invention provides an excellent light reflective effect and a delicate silky hand, the qualities which have never been found in the conventional alkali-treated polyester fiber or other modified polyester fibers.

The above-mentioned unique structure can be produced by an ingenious employment of microfine particles which are finer than those of particulate inert materials so far employed for the modification of fibers, that is to say microfine particles of the order approximating the internal micro-structure of the fiber itself. Thus, the unique structure of the fiber according to this invention can be obtained with excellent reproducibility by adding such microfine particles to the fiber material and extracting them out of the formed fiber. It has been found that the process comprising incorporating a microfine particulate inert material of the order of no more than 100 millimicrons, preferably no more than 60 millimicrons, in average diameter, in a polyethylene terephthalate polymer at the level of 0.5 to 10 weight percent based on the weight of the polymer, melt-spinning the same polyethylene terephthalate polymer, drawing the resulting tow to obtain a polyester fiber and extracting the surface layer of the fiber with a solvent caused an uneven dissolution in the inner microstructural portion of the fiber containing the microfine particles so that a very delicate and complicated irregular configuration is developed over the entire surface of the fiber.

It has also been found that as regards said microfine particulate material, silica sol is particularly desirable from the standpoint of the development of very delicate projections and recesses and the stability of the drawing and other processes. By way of example, if 3 weight % of silica having a particle diameter of 30 millimicrons and a specific gravity of 2.2 g/cm$^3$ is evenly dispersed in a polyester fiber material having a specific gravity of 1.39, the volume of the polyester occupied by a single particle of the particulate material is equivalent, on simple culculation, to a cube about 900 by 900 by 900 angstrom units. Similarly, if 3 weight % of a silica having a particle diameter of 15 millimicrons is evenly dispersed in said polyester, the volume of polyester occupied by each particle of the silica will be equivalent to about 450$^3$ angstrom units. It appears that such a microfine structure in the range of a few hundred angstrom to a thousand angstrom units results in a non-uniform dissolution at the extraction of the surface layer of the fiber, thus giving rise to a delicate and complicated irregularity of the fiber surface.

The incorporated particles are present either in the monoparticulate form or in the second-order form which is an aggregation of plural particles. This is evident when a fiber chip or a spun fiber is sliced to a thickness larger than the diameter of a single particle present in the fiber and smaller than a few times the same diameter, i.e. tens of millimicrons to about 100 millimicrons, by means of an ultra-microtome and the specimen is viewed under a transmission type electron microscope at high magnification.

The non-uniform pattern of dissolution of the fiber surface is influenced by the state of dispersion of these microfine particles. It is difficult to obtain projections and recesses larger than a few times the diameter of a single particle when the particles have been completely evenly dispersed. In contrast, when the particles have been only unevenly dispersed, the portions of the fiber surface where particles are present at high densities tend to be readily eroded and dissolved in the surface extraction process thus giving rise to recesses larger than the recesses produced in the areas where particles have been present at lower densities, with the result that the desired surface irregularity is obtained. It is important that such irregularity is developed at random and, yet, evenly over the entire surface of the fiber.

In the context of this invention, the term "second-order particle" means the particles adjacent to each other with the center-to-center distance being less than twice the diameter of each particle. The second-order particle according to the above definition can be ascertained distinctly from single particles from a transmission type electron micrograph at a magnification which allows the diameter of each single particle to be recognized, e.g. 100,000 times when the particle diameter is 10 millimicrons or 10,000 times when the particle diameter is 100 millimicrons. Thus, in accordance with this invention, a sliced specimen is prepared which has a thickness of 50 to 100 microns and, based on a transmission type electron microphotograph enlarged to a magnification which allows the diameter of each single particle to be ascertained, the distribution of second-order particles is evaluated. Our study has shown that the condition in which at least five second-order particles from 0.1 to 0.5 microns by the above definition are present per 10 square microns is conducive to the development of the desirable random projections and recesses *plus* delicate minor projections and recesses. It should be understood that the excessive aggregation of single particles is undesirable, for it could introduce an instability factor to the fiber-making process. Thus, it is preferable to ensure that no more than 20 second-order particles in excess of 5 microns in diameter be present per 1 mm$^3$ of the polymer.

In the production of such polyester polymers, the use of a colloidal silica in which single or primary, fine silica particles having diameters 1-100 millimicrons are dispersed, for example, is recommendable. The word "colloidal silica" means a colloid comprising fine particles composed mainly of silicon oxide dispersed in a dispersion medium which is water, a monohydric alcohol, a diol, or a mixture of these.

In cases where the polyester polymers are produced by direct esterification, the addition of the colloidal silica to the esterification tank or vessel is carried out either by the method comprising first adding the colloidal silica to a slurry composed of the acid component and the glycol component and then feeding the esterification vessel with the slurry or by the method of direct addition of the colloidal silica to the esterification vessel.

In the former case preferaby the slurry is prepared by first mixing the colloidal silica with the glycol component, stirring sufficiently and then blending the mixture with the acid component. The concentration of the colloidal silica just before the addition to the slurry is preferably below the critical concentration of 80% at which the colloid begins to aggregate. Although too low a concentration is not preferred because the dispersion medium in the slurry amounts to too much, said concentration should be as low as possible.

For better dispersion of the fine silica particles, it is preferred that the molar ratio between the glycol component and the acid component be large. On the other hand, when said ratio is too large, evil influences may be produced, such as an increase in the amount of byproducts formed. Therefore, preferred are molar ratios in the range of 1.01–2.0, more preferably 1.05–1.60. It is also preferred that the slurry be prepared at temperatures between room temperature and 100° C., at most below 120° C. Once prepared, the slurry may be heated to temperatures above 120° C., and such heating is rather preferred because of convenience in the esterification step and because of possibility of improving dispersion of the silica particles.

In the latter case (direct addition of the colloidal silica), like in the former case, it is preferred that the concentration of the colloidal silica be as low as possible. When, for example, a polyethylene terephthalate type polymer is to be produced, it is preferred to lower the concentration of the colloidal silica as much as possible with ethylene glycol. However, too much ethylene glycol tends to offer such a disadvantage as formation of byproduct diethylene glycol. Therefore, the molar ratio of the glycol component to the acid component in the whole system should be adjusted within the range not exceeding 2.5.

The silica so prepared is fed to the esterification vessel or tank. Since one of the factors dominating the dispersibility of silica particles is the temperature of the reaction system to which the slurry is fed, i.e. too high a temperature of the system tends to cause aggregation due to thermal shock, and once they have aggregated, redispersion is almost impossible. Therefore, it is necessary that the temperature of the system be lower than 295° C., preferably lower than 290° C. in case of continuous polymerization processes, or lower than 280° C., preferably lower than 260° C. in case of batch polymerization.

In case where the polyester polymers are to be produced by transesterification, aqueous dispersion media are unfavorable to the colloidal silica because they interfere with the transesterification. In the case of an aqueous dispersion medium, it is necessary to remove water prior to the transesterification. The colloidal silica is preferably added to the reaction system before commencement of the transesterification reaction so as to protect it against thermal shock. In cases where the colloidal silica is added during or after the transesterification, the temperature of the system should be lower than 235° C., preferably lower than 215° C. in case of continuous polymerization processes, or lower than 200° C., preferably lower than 160° C. in case of batch polymerization, as mentioned above, to prevent the aggregation due to thermal shock.

In any of the cases mentioned above, higher molar ratios between the glycol component and the acid component are preferable from the viewpoint of dispersibility of silica, but conversely unfavorable in respect of byproduct formation etc., and therefore it is preferred that the molar ratio in question is not greater than 3.0, preferably 2.5 or less.

Preferably, the reaction system is stirred as vigorously as possible but of course within appropriate limits so that great shearing stresses may be imposed on the system so as to improve the state of dispersion of silica particles.

Under the same conditions of stirring, higher degrees of polymerization, therefore higher viscosities, can bring greater shearing stresses. From practical standpoints and within the scope of the objects, therefore, it is necessary that the number average degree of polymerization be at least 70, preferably 90 or more. When the number average degree of polymerization does not reach 70, the polyester polymers cannot acquire strength sufficient to make fibers or films and at the same time unfavorable effects may be produced on dispersibility of silica particles.

The process of the present invention produces fibers by using the polyester polymers prepared by such a method as mentioned above and containing fine particles and having number average polymerization degree of 70 or more and by employing conventional methods of spinning, drawing etc. When the size of the particles added to the polymer exceeds 100 millimicrons, undesirably there result greater values of X (which represents the surface irregularity or ruggedness after dissolution treatment of the fiber surface, decreased number of recesses and projections constituting the random surface), dull color and marked whitishness after dyeing. In order to attain uniform dispersion of particles, better stabilize the spinning and drawing processes and produce better effects on the gloss or depth of color, it is desirable that the particle size be not greater than 100 millimicrons, preferably not greater than 60 millimicrons.

As such particles, there may be used, for example, silica sol, fine particle silica, alumina sol, fine particle alumina, microfine titanium dioxide, calcium carbonate sol, fine particle calcium carbonate, modified silica sol with well improved dispersion stability or other colloids and fine particle of inert substances having refractive indexes close to those of the polyester fibers. In respect of fiber transparency, color vividness and good luster, however, silica sol is most effective. Investigations on the amount of the fine particles to be added have revealed that with addition of less than 0.5 weight percent the surface irregularity after the dissolution treatment of the fiber surface layer is insufficient to obtain improvement in color deepness or gloss. With quantities of the fine particles exceeding 10 weight percent, spinning is very difficult, and addition of such quantities is thus practically out of the question. Polyester fibers melt spun from the polymer component containing said fine particles in an amount of 0.5–10 weight % and drawn have not yet minutely uneven or rugged surfaces, though streaks running along the fiber axis are observable. Only wnen the fiber surface layer is treated with a solvent capable of dissolving or decomposing the polyester fiber, the desired surface irregularity mentioned above is realized. In cases where the fiber is dyed in the form of a woven or knitted fabric, the dissolution-/erosion treatment of the fiber surface is preferably carried out before the dyeing, whereas in the case of fiber dyeing or raw stock dyeing it is preferable for reasons of convenience in color matching to subject the fiber to the dissolution/erosion treatment in the form of fiber, yarn, raw stock or tow. Even when the treatment is conducted after dyeing, however, minute and complicated surface irregularity can invariably be realized. Thus the surface dissolution/erosion treatment may be carried out in any appropriately chosen step. An example of the dissolution/erosion treatment of the polyester-type synthetic fiber is, but is not limited to, an alkali treatment using caustic soda, for instance.

It is desirable, however, to select as far as possible a common solvent for both the polyester component constituting the fiber and the fine particles added to and present in the fiber. Especially preferable is the use of a common solvent in which the rate of dissolution or decomposition of the fine particles is several times to scores of times higher than that of the polyester, because more minute and more complicated fiber surface irregularity may result therefrom. In this regard, combined use of silica particles as fine particles and caustic soda as solvent is very favorable, since silica is dissolved more than ten times faster than the polyester is dissolved.

The polyester fiber to be used in the practice of this invention contains not only single or primary particles well dispersed therein but also well dispersed second-order particles having sizes of 0.1–0.5 micron and therefore having been formed by not so excessive aggregation.

When the particle-containing fiber is treated with an alkali, first a number of fine particles that are present on the fiber surface are dissolved, then fine particles located within the fiber and surrounding the dissolution points on the surface are dissolved, and dissolution goes on three-dimensionally, so that the resulting pores constitute complicated porous structures in the direction of the fiber axis as well as in the direction of the fiber circumference, said pores, isolatedly or partly overlapping, producing very minute surface irregularity. Whereas a known method of giving surface irregularity to a fiber by plasma treatment provides a surface having relatively simple and large recesses and projections, the fiber of the present invention has a surface clearly distinguishable in size and irregularity of recesses and projections from the fiber surface obtainable by said plasma treatment method.

Further, when the fiber provided with a irregular surface according to the invention is again subjected to the surface dissolution treatment, an irregularly uneven surface as mentioned above can be again produced because fine particles are present within the fiber uniformly. In the case of said plasma treatment or surface roughening by foaming, it is difficult to obtain such a surface recovery phenomenon. On the contrary, the process of this invention has a unique advantage in that a second surface dissolution treatment can restore a similar desirable surface when the loss in weight due to the surface dissolution reaches 10–15%. This advantageous feature makes it possible to obtain a desired surface even when the order of process steps is altered, provided that said surface dissolution is carried out, or to reprocess dyed products in the step of finishing them.

The polyester fiber produced by the process of this invention shows a unique change in friction characteristics before and after the alkali treatment. Thus, the fiber surface not yet treated with an alkali has no minute recesses and projections and shows friction characteristics similar to those shown by usual polyester fibers. Treatment of this fiber with an alkali, however, gives a fiber having an excellent surface hand, the difference ($\mu_s-\mu_d$) between the coefficient of static friction $\mu_s$ and that of dynamic friction $\mu_d$ after the alkali treatment showing a significant increase compared with the difference $\mu_s-\mu_d$ before the treatment so that the ratio $\mu_s/\mu_d$ after the treatment amounts to at least 1.7. The difference $\mu_s-\mu_d$ increases as the degree of dissolution of the fiber surface due to the alkali treatment increases, and as a result there are obtained such properties as dry touch, "kishimi" and crispness, which are characteristic of silk.

As will be understood from the above explanation, the present invention attains the desired end by giving a peculiar structure to the fiber surface, and is of course applicable also to conjugate fibers having sheath-core or side-by-side structures. In these cases, more advanced characteristic features owing to changes in feeling, gloss or quality feeling can be realized by making a fiber composed of a sheath component or one side component consisting of a polyester type polymer containing 0.5–10 weight % fine particles with diameters not greater than 100 millimicrons, preferably not greater than 60 millimicrons, preferably silica sol, and a core component or the other side component consisting of a polymer of the same or different kind with or without the same or different content of fine particles as mentioned above, and subjecting the fiber to a surface layer dissolution/erosion treatment with a solvent capable of dissolving or decomposing said polyester type polymer, giving a synthetic fiber having minute and complicated recesses and projections appearing randomly on the surface.

It is a matter of course that the process of the present invention is applicable to the cases where the fiber has a cross-section resembling a pentagon or hexagon as a result of yarn treatment such as false twisting and to the cases where the fiber cross-section has a form having three, four, five, six, seven, eight or more leaves or a T or some other shape as a result of spinning through a spinneret with modified cross-section holes. The false-twisted yarn that has undergone the process of this invention glitters very little, and therefore this invention provides an antiglitter effect on false-twisted yarn (DTY) of POY yarns obtained by high-speed spinning.

The polyester polymers referred to herein are those having repeating glycol dicarboxylate structural units of which at least about 75% are

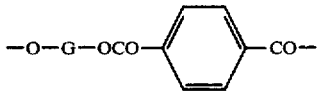

units (—G— being bivalent organic groups containing 2–18 carbon atoms and bound to both the adjacent oxygen atoms through saturated carbon atoms). Either the terephthalate group is the only dicarboxylate component of the repeating structural units or the repeating structural units may contain up to about 25% adipate, sebacate, isophthalate, bibenzoate, hexahydroterephthalate, diphenoxyethane-4,4'-dicarboxylate, 5-sulfoisophthalate or other dicarboxylate. Glycols involved are ethylene glycol, tetramethylene glycol, hexamethylene glycol and other polymethylene glycols, 2,2-dimethyl-1,3-propanediol and other branched glycols, diethylene glycol, triethylene glycol, tetraethylene glycol, etc. Mixtures of these may be used. Optionally, higher glycols such as high molecular weight polyethylene glycols may also be added in amounts up to about 15 weight percent.

Delustering agents, luster improving agents, discoloration inhibitors and various other substances may also be added, if necessary.

This invention is further illustrated by the following examples, which are not to be construed as limiting the present invention.

EXAMPLE 1

A silica-containing slurry was prepared by mixing a 20 weight % silica hydrosol having a particle size distribution range of 10–20 millimicrons with ethylene glycol at room temperature, stirring the mixture sufficiently, and blending the mixture with terephthalic acid in such an amount that the molar ratio of said ethylene glycol to the terephthalic acid amounted to 1.2. The slurry was fed continuously to an esterification vessel and the esterification was effected at a temperature of 250° C. and an internal pressure of 1.2 kg/cm$^2$, and the esterification product with an esterification degree of 98% was subjected to polymerization at 285° C. to give a polyester polymer with a number average polymerization degree of 95. The polymerization catalyst used was $Sb_2O_3$. By this procedure, a number of polymers with varying amounts of silica sol added from 0.1 to 15% by weight were prepared, and each polymer was subjected to melt spinning and usual drawing, and made into drawn yarns composed of 150-denier/30 filaments. In the cases where the silica sol content was 12 or 15 weight %, spinnability was bad and yarn specimens could not be obtained. The drawn yarns obtained were given false twist, and each specimen was made into a knitted fabric. The knitted fabric was subjected to alkaline scouring using a 4 weight % caustic soda solution at 95° C. The loss on alkaline scouring was checked for each sample and attention was paid so as to control the loss within the range of 3–6%.

Each knitted fabric was dyed under the following conditions, then the reflectance of the fabric was measured using a Hitachi EPR-2 self-registering spectrophotometer and the change in color deepness was determined from the change in reflectance and the irregularity of the fiber surface from pictures taken on a scanning-type electron microscope. The results are shown in Table 1.

CONDITIONS OF DYEING

Dyestuff: Dianix Black HG-SE (Mitsubishi Chemical Industries), 12% o.w.f.

Dispersing and levelling agent: Toho Salt TD (Toho Chemical), 0.5 g/liter pH regulator: Ultra MT-$N_2$ (Miteshima Chemical), 0.7 g/liter Bath ratio: 1:30

Temperature programming:

-continued

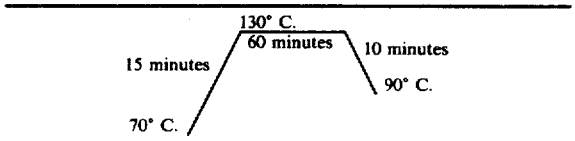

Reduction cleaning:

| | | |
|---|---|---|
| Hydrosulfite | 1 g/liter | 80° C. × 10 minutes |
| Caustic soda (36° Be) | 1 g/liter | |
| Nonionic surfactant | 1 g/liter | |

TABLE 1

| Silica sol content weight % / Item | 0 | 0.1 | 0.5 | 1.0 | 1.5 | 2.0 | 3.0 | 6.0 | 8.0 | 10.0 |
|---|---|---|---|---|---|---|---|---|---|---|
| Loss on alkaline scouring, % | 3.3 | 3.7 | 3.8 | 4.0 | 3.9 | 3.0 | 3.0 | 3.3 | 4.3 | 4.9 |
| Decrease in reflectance at wavelength 460 mμ as compared with that of sample with 0% silica sol content, % | — | 0.05 | 0.2 | 0.3 | 0.6 | 0.7 | 0.9 | 1.2 | 1.4 | 1.5 |
| Surface irregularity or ruggedness, X, micron | — | 0.2–1.2 | 0.2–0.8 | 0.2–0.7 | 0.2–0.6 | 0.2–0.5 | 0.2–0.5 | 0.2–0.5 | 0.2–0.5 | 0.2–0.4 |
| Random surface | No | No | Yes | Yes | Yes | Yes | Yes | Yes | Yes | Yes |
| Depth of color | No | No | Yes | Yes | Yes | Yes | Yes | Yes | Yes | Yes |
| Gloss | Bad | Bad | Good | Good | Good | Good | Good | Good | Good | Good |

When the silica sol content was 0.1%, the fiber had no random surface, with the X value, representing irregularity or ruggedness, being greater than 0.7 micron, the decrease in reflectance was slight, color deepness was not manifested, and improvement in gloss was hardly perceptible. On the contrary, when silica sol was added in an amount of 0.5% or more, the fiber had an irregularly uneven random surface which in turn comprised microstructures composed of walls having granular structures, sizes of the granules being 50–200 millimicrons. Although the X value was not constant, recesses and projections satisfying the requirement X=0.2–0.7 micron were distributed at a density of 10–45 per 10 micron portion of the fiber circumference on a plane perpendicular to the fiber axis. In these cases, the deepness of black color was increased, and the gloss was gentle and good. Although Table 1 does not indicate any distinction in respect of the color deepness and gloss for the cases where the silica sol content was 0.5 weight % or more, the greater the amount added was, the deeper the color and the better the gloss was.

Further, in the cases where the silica sol content was 0.5 weight % or more, each knitted fabric showed distinct improvement in surface hand.

COMPARISON 1

Using a same condition as in Example 1, a slurry was prepared so that the silica content in the polymer to be formed of 3 weight % might be obtained. Said slurry was fed to an esterification vessel wherein the reaction system temperature was 285° C., under the same condition as in Example 1, to cause esterification and polymerization. There was obtained a polymer having a number average polymerization degree of 90. When this polymer was spun, only in an hour the filtering pressure sharply increased and spinning was already impossible, filament break occurring frequently during the spinning. When observed under an electron microscope, this polymer showed the presence of 60 or more secondary particles having sizes exceeding 5 microns in each cubic millimeter of the polymer, suggesting an intense aggregation of primary silica particles.

COMPARISON 2

Using a same condition as in Example 1, a slurry was prepared so that the silica content in the polymer of 3 weight % might be obtained. The resulting slurry was subjected to esterification and subsequent polycondensation as in the same condition of Example 1, and a polymer having a number average polymerization degree as low as 65 was prepared. In spinning and drawing, filaments broke frequently during the spinning because of low strength of the polymer, and filament break and fluff formation occurred frequently during the drawing, too, and no fiber of practical use could be obtained. Electron microscopic observation of the polymer revealed that the degree of dispersion of silica particles was almost the same as in Example 1 and therefore the dispersibility was good.

EXAMPLE 2

Using various kinds of particles specified, and proceeding as in Example 1, various polyester polymers containing various particles in amounts equal to 1.5 weight % were prepared. Each polymer was melt spun by a usual process, the filament drawn in a water bath and cut into a 2.5-denier staple having a length of 51 mm, and the staple made into a 30'S/1 spun yarn, from which knitted fabric was produced.

The fabric was subjected to the alkaline scouring and dyeing as mentioned in Example 1, and the fiber surface irregularity and color deepness after dyeing of the knitted fabric and change in gloss were examined. The results are shown in Table 2. The greater the particle size was, the more of the good quality of color deepness and gloss was lost, the worst case being the one where titanium oxide with a particle size of about 200 millimicrons was used. With a silica sol having particle sizes of about 120–150 millimicrons or with calcium carbonate having particle sizes of 80–100 millimicrons, a certain effect of color deepening was indeed obtained, but was inferior in quality to those produced with smaller particles. When the loss on alkaline scouring was great, the color already began to look dark and dull due to the occurrence of recesses and projections at intervals of more than 0.7 micron. In the case of alumina powder, although it had a primary particle size of about 20 millimicrons, the X values as defined herein amounted to more than 0.7 micron and no improvement in color deepness and gloss could be produced, perhaps because the pressure rise was sharp and the distribution of the particles within the polymer was not good as could be guessed from the actual situation of the spinning. When a silica powder having a particle size of about 7 millimicrons or a fine titanium oxide powder having a particle size of about 30 millimicrons was used, the black color had deepness and the gloss was good. In conclusion, silica sols having particle sizes up to 80–90 millimicrons were suitable, and especially silica sols having particle sizes of 10–60 millimicrons gave excellent results.

TABLE 2

| Kind of particles | Silica sol | Silica sol | Silica sol | Silica sol | Silica powder | Fine titanium oxide powder | Titanium oxide | Alumina powder | Calcium carbonate | Calcium carbonate | control (none) |
|---|---|---|---|---|---|---|---|---|---|---|---|
| Particle size, mμ | 10–20 | 40–60 | 80–90 | 120–150 | ca. 7 | ca. 30 | ca. 200 | ca. 20 | 80–100 | 80–100 | — |
| Loss on alkaline scouring | 3.9 | 4.1 | 4.9 | 3.3 | 3.2 | 4.4 | 5.3 | 3.4 | 5.9 | 15.0 | 3.3 |
| Depth of black color* (organoleptic examination) | 3.0 | 2.5 | 2.0 | 1.5 | 2.5 | 2.0 | −2.0 | 0.5 | 1.5 | −1.0 | 0 |
| Surface irregularity | 0.15–0.5 | 0.2–0.8 | 0.2–0.9 | 0.3–1.5 | 0.2–0.7 | 0.2–0.8 | 0.8–1.5 | 0.7–1.0 | 0.3–0.9 | 0.3–1.5 | 0.05–0.15 |
| Gloss | Good | Good | Good | Normal | Good | Good | Bad | Normal | Good | Rather bad | Normal |

*Depth of black color: Evaluated by an organoleptic examination. The greater the numerical value is, the deeper the color appears. The smaller the value is, the duller and the less deep the color is.

EXAMPLE 3

Using a silica hydrosol having a particle size of about 45 millimicrons and a concentration of 40 weight % and proceeding as in Example 1, there was obtained a polymer (A) with a silica sol content of 3 weight %. The intrinsic viscosity [η] of this polymer as determined in an ortho-chlorophenol solution at 25° C. was 0.51. Separately, a polyethylene terephthalate (B) with an intrinsic viscosity [η] of 0.75 and without additives was prepared.

With a combination of component A and component B, sheath-core conjugate spinning of the eccentric type was carried out, with component A used as sheath component and component B used as eccentric core component. The conjugate spun filaments were drawn and then passed through a hollow heater at 185° C. with overfeeding so as to actualize latent crimp. There was obtained a crimped yarn composed of 75-denier/36 filaments. As a control sample, there was prepared a false twisted yarn composed of 75-denier/36 polyester filaments containing 0.02 weight % titanium oxide (particle size: about 200 millimicrons).

These two kinds of yarns were each made into a 2/2 twill woven fabric with a warp density of 125 yarns/inch and a weft density of 95 yarns/inch. In a usual dyeing process, each fabric, after heat setting, was subjected to a fiber surface dissolution/erosion treatment. The treatment was carried out using caustic soda as solvent until about 15% loss was attained. The fabric was further subjected to usual finishing treatments, and evaluated for feeling and appearance.

The fabric made of the eccentric core-in-sheath conjugate polyester yarn composed of component A and component B was soft and flexible, resembled silk twill "habutae", and was by far superior in color development and color deepness to the control, false twisted polyester yarn fabric.

EXAMPLE 4

Using polymers (A) and (B) obtained in Example 3, side-by-side structure conjugate filaments were melt spun with a conventional apparatus. The ratio of conjugation was A:B=6:4. The filaments were drawn and passed through a hollow heater at 180° C. at an overfeed rate of 50% so as to cause relaxation and make latent crimp develop. The so-obtained crimped yarn composed of 75-denier/36 filaments was made into a knitted fabric, which was subjected to the heat treatment and caustic soda treatment as in Example 3 until the loss reached about 10%. Some fiber was taken out of the fabric and its surface was examined on a picture taken on a scanning electron microscope. On the outside of a crimp structure, there was observed a minutely and irregularly uneven or rugged random surface as mentioned hereinbefore over about 60% of the fiber circumference. The knitted fabric sample did not glitter at all even in direct rays of the sun, and felt soft and flexible.

EXAMPLE 5

A silica hydrosol having an average particle size of 15 millimicrons and a concentration of 20 weight % was mixed with ethylene glycol at room temperature, and the mixture, after sufficient stirring, was blended with terephthalic acid. The resulting slurry was subjected to esterification and subsequent polycondensation, giving a polyethylene terephthalate having an intrinsic viscosity [$\eta$] of 0.67 and and a silica content of 3 weight %.

Separately, using a silica hydrosol having an average particle size of 45 millimicrons and a concentration of 20 weight % and proceeding as above, there was obtained a polyethylene terephthalate having an intrinsic viscosity [$\eta$] of 0.69 and a silica content of 3 weight %.

As a control, a polyethylene terephthalte having an intrinsic viscosity [$\eta$] of 0.69 and a titanium oxide content of 0.45 weight % was prepared by using titanium oxide having an average particle size of 200 millimicrons and proceeding as above.

Each polymer was spun by a conventional method, and, after drawing, there were obtained a bundle of 75-denier/36 filaments each presenting a round cross-section and a bundle of 75-denier/36 filaments each presenting a T-shaped cross-section. Each filament yarn was twisted in the Z direction at a rate of 250 T/M, and made into a "habutae" fabric. The grey fabric density was 104 warps/inch by 85 wefts/inch and the finished fabric density 119 warps/inch by 100 wefts/inch. In the scouring and finishing process, the fabric, after heat setting, was subjected to dissolution/erosion of the fiber surface using a caustic soda solution. The weight loss in this treatment and the results of an organoleptic test on the feeling of the "habutae" are shown in Table 3. On the other hand, in order to precisely appreciate the friction behavior of the filament yarn, the same filament yarn as used for making the fabric was made into a hank beforehand and subjected to the same scouring and finishing treatments and given the same heat treatment as in the case of the fabric and then fiber surface dissolution treatment was carried out under the same conditions as employed for the fabric. The fiber surface irregularity of the filament yarn so obtained was examined on a picture taken on a scanning electron microscope, and the friction coefficient between yarns was measured by the Röder method described hereinabove. An uneven microstructure comprising smaller recesses and projections of sizes of 50–200 millimicrons was observed all over the filament yarn surface, and there was a random surface with greater recesses and projections each containing said uneven microstructure. The recesses and projections forming the random surface had such X values defined herein that satisfied the requirement 0.2 micron $<X<$ 0.7 micron, and were present at a density of 13–40 per 10 micron portion of the fiber circumference on a plane perpendicular to the fiber axis. The coefficient of static friction $\mu_s$ and of dynamic friction $\mu_d$ of the filament yarn and the ratio $\mu_s/\mu_d$ are also shown in Table 3. These measurements were made also on a control sample prepared without the surface dissolution treatment but otherwise under the same conditions and therefore having the same history except for the surface dissolution.

As can be seen from Table 3, the yarns according to the present invention had much increased $\mu_s$ values owing to the surface dissolution treatment, the ratio $\mu_s/\mu_d$ thus amounting to 1.7 or more, up to about 2.3. Distinct correspondence of the $\mu_s/\mu_d$ values to the results of the organoleptic test on the feeling of the habutae fabric could be ascertained. Thus, as the $\mu_s/\mu_d$ value exceeded 1.7, the feeling began to alter, "Numeri" (Waxy and smoothness), disappearing and "kishimi" appearing. Especially when the $\mu_s/\mu_d$ value was 1.9 or more, silk voice characteristic of silk occurred. Various fabrics other than habutae were made of those yarns that could utter silk voice and "Kishimi". When a necktie was made and worn, it retained its shape and hardly loosened. In the case of a scarf, dry feeling could be obtained, and in the case of a blouse or one piece dress, crispness and cool feeling resembling those of silk could be produced. Thus it has become possible to produce articles having new feeling that has never been thought of with conventional polyester-type synthetic fiber fabrics.

TABLE 3

| Sample No. | Particles and size | Fiber cross-section | Weight loss (%) | Friction characteristics of yarn | | | Feeling of habutae fabric** | | | |
|---|---|---|---|---|---|---|---|---|---|---|
| | | | | $\mu_s$ | $\mu_d$ | $\mu_s/\mu_d$ | Numeri | Kishimi | silk voice | Softness |
| I-O-1 | | Round | 0* | 0.289 | 0.189 | 1.53 | 5 | 1 | – | 1 |
| 2 | | | 2 | 0.300 | 0.175 | 1.71 | 3 | 3 | – | 1 |
| 3 | Silica | | 9 | 0.393 | 0.194 | 2.03 | 1 | 5 | + | 2 |
| 4 | 15 mμ | | 30 | 0.488 | 0.249 | 1.96 | 1 | 5 | + | 5 |
| I-T-1 | | T | 0* | 0.249 | 0.162 | 1.54 | 4 | 2 | – | 1 |

TABLE 3-continued

| Sample No. | Particles and size | Fiber cross-section | Weight loss (%) | Friction characteristics of yarn $\mu_s$ | $\mu_d$ | $\mu_s/\mu_d$ | Feeling of habutae fabric** Nimmer | Kishimi | silk voice | Softness |
|---|---|---|---|---|---|---|---|---|---|---|
| 2 | | | 2 | 0.312 | 0.163 | 1.63 | 3 | 4 | — | 2 |
| 3 | | | 10 | 0.356 | 0.191 | 1.97 | 3 | 5 | + | 2 |
| 4 | | | 28 | 0.427 | 0.233 | 1.85 | 3 | 5 | + | 5 |
| II-O-1 | | Round | 0* | 0.284 | 0.178 | 1.59 | 4 | 2 | — | 1 |
| 2 | | | 2 | 0.401 | 0.184 | 1.64 | 3 | 4 | — | 1 |
| 3 | | | 12 | 0.414 | 0.185 | 2.27 | 2 | 5 | — | 2 |
| 4 | Silica 45 mμ | | 27 | 0.466 | 0.205 | 2.27 | | 4 | + | 5 |
| II-T-1 | | T | 0* | 0.255 | 0.158 | 1.60 | | 2 | — | 1 |
| 2 | | | 1 | 0.292 | 0.169 | 1.73 | | 4 | — | 1 |
| 3 | | | 7 | 0.314 | 0.164 | 1.91 | 3 | 5 | + | 2 |
| 4 | | | 23 | 0.404 | 0.208 | 1.95 | 4 | 5 | + | 4 |
| III-O-1 | | Round | 0* | 0.298 | 0.194 | 1.54 | | 1 | — | 1 |
| 2 | | | 2 | 0.311 | 0.211 | 1.47 | 3 | 1 | — | 1 |
| 3 | | | 9 | 0.274 | 0.179 | 1.53 | 3 | 1 | — | 3 |
| 4 | Titanium oxide 200 mμ | | 31 | 0.344 | 0.216 | 1.59 | | 1 | — | 5 |
| III-T-1 | | T | 0* | 0.248 | 0.157 | 1.58 | 3 | 1 | — | 1 |
| 2 | | | 2 | 0.281 | 0.200 | 1.41 | 3 | 1 | — | 1 |
| 3 | | | 11 | 0.294 | 0.197 | 1.42 | 4 | 1 | — | 3 |
| 4 | | | 29 | 0.318 | 0.206 | 1.54 | 5 | 1 | — | 5 |

*No treatment
**Organoleptic test results. The greater the value is, the stronger the feeling is.
***+ Silk voice uttered;
— No silk voice.

EXAMPLE 6

To a slurry consisting of ethylene glycol, terephthalic acid and isophthalic acid as main components in a terephthalic acid to isophthalic acid molar ratio of 92:8 and in an ethylene glycol to terephthalic acid molar ratio of 1.5 and containing 400 ppm of $Sb_2O_3$ as polymerization catalyst, there was added an aqueous colloidal silica having an average particle size of 45 millimicrons and a concentration of 20 weight % in such an amount that the silica particles amounted to 5 weight % of the resulting polyester, and the slurry was stirred sufficiently. Then the slurry was continuously fed to an esterification vessel, in which the reaction system temperature was 250° C. and the internal pressure was 2 kg/cm$^2$ over 4 hours. Then the esterification was continued while raising the temperature to 265° C. The resulting esterification product with an esterification degree of 76.5% was subsequently subjected to polymerization at 285° C. The polyester polymer so obtained and having a number average polymerization degree of 90 was spun and the filaments were drawn, without any trouble throughout the process. Electron microscopic observation of this polymer showed that 60 second-order particles having sizes of 0.1–0.5 micron on the average were present per 10 square microns and that second-order particles having sizes exceeding 5 microns were present in the proportion of 0.1 per 1 cubic millimeter (mm$^3$). The dispersibility of the silica added was thus very good.

EXAMPLE 7

To an esterification vessel in which ethylene glycol and terephthalic acid as main components in an ethylene glycol-to-terephthalic acid molar ratio of 1.2 were esterified to an esterification degree of 85% at a temperature of the reaction system of 230° C., there was fed continuously over an hour a colloidal silica having an average particle size of 25 millimicrons and a concentration of 30 weight % and containing ethylene glycol as dispersion medium, in such an amount that the silica particles in the resulting polymer amounted to 7 weight %. Then the esterification was brought to termination and further the polycondensation reaction was carried out to give a silica-containing polyethylene terephthalate with a number average polymerization degree of 95. This polymer could be spun and drawn without any trouble throughout the process. Electron microscopic observation of this polymer showed the presence of about 200 second-order particles having sizes of 0.1–0.5 micron per 10 square microns but could hardly show the presence of second-order particles having sizes exceeding 5 microns.

EXAMPLE 8

To a mixture of dimethyl terephthalate and sodium salt of 5-sulfo dimethyl isophthalic acid (molar ratio=97.5:2.5) was added ethylene glycol in such an amount that the molar ratio of ethylene glycol to the acid components amounted to 2.2, and further sodium acetate was added as ester exchange catalyst at a concentration of 1000 ppm. To the resulting system, a colloidal silica having an average particle size of 15 millimicrons and a concentration of 20 weight % and containing methanol as dispersion medium was added so that a silica content in the polymer to be formed of 0.5 weight % might be obtained. The whole mixture was subjected to ester exchange and subsequent polycondensation, and the resulting polyester polymer having a number average polymerization degree of 80 was spun and the filaments were drawn, without any trouble throughout the whole spinning process. Electron microscopic observation of this polymer revelaed that about 6 second-order particles having sizes of 0.1–0.5 micron were present per 10 square microns, but that second-order particles having sizes exceeding 5 microns were hardly found. These facts demonstrated good dispersibility of the silica particles.

What is claimed is

1. A polyester synthetic fiber having an irregularly uneven random surface constituted by recesses and projections, said recesses and projections (a) satisfying the condition that $$0.2 \text{ micron} < X < 0.7 \text{ micron}$$

where X is the distance from the deepest point of a recess to that of the recess adjacent thereto in the fiber circumferential direction perpendicular to the fiber axis, (b) being distributed at a density of from 10 to 50 per distance of 10 microns as measured in the fiber circumferential direction perpendicular to the fiber axis, and (c) having additional microfine recesses and projections within the size range of 50 to 200 millimicrons distributed thereon.

2. A fine-particle-containing polyester synthetic fiber which contains from 0.5 to 10 weight % of fine particles less than 100 millimicrons in diameter, there being at least 5 second-order particles having a size of from 0.1 to 0.5 microns per 10 square microns with no more than 20 second-order particles exceeding 5 microns present per 1 $mm^3$ of fiber, said second-order particles being defined as particle groups each presenting, on a picture taken on an electron microscope and magnified to such an extent that each primary single particle can be identified, a state in which the neighboring primary particles are so close to each other that the distance between the centers of said neighboring primary particles is less than twice the diameter of one primary particle.

3. The fine-particle-containing polyester synthetic fiber of claim 2 wherein said fine particles are silica particles.

4. The polyester synthetic fiber of claim 1, wherein the ratio ($\mu_s/\mu_d$) of the coefficient of static friction $\mu_s$ to the coefficient of dynamic friction $\mu_d$ as measured between fibers is 1.7 or more.

5. A polyester synthetic fiber according to claims 1 or 4 prepared by extracting with a solvent the fine particles contained in a fine-particle-containing polyester fiber having from 0.5 to 10 weight % of fine particles less than 100 millimicrons in diameter, there being at least 5 second-order particles having a size of from 0.1 to 0.5 microns per 10 square microns with no more than 20 second-order particles exceeding 5 microns present per 1 $mm^3$ of fiber, said second-order particles being defined as particle groups each presenting, on a picture taken on an electron microscope and magnified to such an extent that each primary single particle can be identified, a state in which the neighboring primary particles are so close to each other that the distance between the centers of said neighboring primary particles is less than twice the diameter of one primary particle.

6. A polyester synthetic fiber according to claim 5 in which the particles contained in fine-particle-polyester fiber are silica particles.

7. A process for producing a polyester synthetic fiber having an irregularly uneven random surface constituted by recesses and projections, said recesses and projections (a) satisfying the condition that $$0.2 \text{ micron} < X < 0.7 \text{ micron}$$

where X is the distance from the deepest point of a recess to that of the recess adjacent thereto in the fiber circumferential direction perpendicular to the fiber axis, (b) being distributed at a density of from 10 to 50 per distance of 10 microns as measured in the fiber circumferential direction perpendicular to the fiber axis, and (c) having additional microfine recesses and projections within the size range of 50 to 200 millimicrons distributed thereon, said process comprising subjecting a fine-particle-containing polyester synthetic fiber of claim 2 to a surface dissolution/erosion treatment with a solvent capable of dissolving or decomposing said fiber.

8. The process of claim 7, wherein the particles in the fine-particle-containing polyester synthetic fiber are silica particles.

9. A process according to claim 8 in which the fine-particle-containing polyester fiber is prepared by adding a colloidal silica having an average particle size of 100 millimicrons or less to the reaction producing the polyester, and melt spinning the resultant fine-particle-containing polyester.

10. A process according to claims 7, 8 or 9 wherein the solvent for the fiber is an aqueous solution of caustic soda.

* * * * *